United States Patent [19]

Hendrix et al.

[11] 4,447,241

[45] May 8, 1984

[54] OXIDATIVE AFTERWASH TREATMENT FOR CREASE RESISTING FABRICS

[75] Inventors: James E. Hendrix; George L. Payet, both of Fort Mill, S.C.

[73] Assignee: Springs Industries, Inc., Fort Mill, S.C.

[21] Appl. No.: 367,398

[22] Filed: Apr. 12, 1982

[51] Int. Cl.[3] ..... D06M 13/12; D06M 13/34; D06M 9/00

[52] U.S. Cl. ..... 8/116.4; 8/182; 8/183; 8/184; 8/185; 8/186; 8/115.7

[58] Field of Search ..... 8/116.4, 182, 183, 184, 8/185, 186, 115.7

[56] References Cited

U.S. PATENT DOCUMENTS

| | | | |
|---|---|---|---|
| 2,040,795 | 5/1936 | Pratt | 8/116.4 |
| 2,220,804 | 11/1940 | Pratt | 8/116.4 |
| 3,104,152 | 9/1963 | McMackin | 8/116.4 |
| 3,183,054 | 5/1965 | Fischer et al. | 8/116.4 |
| 3,198,652 | 8/1965 | Miller et al. | 8/116.4 |
| 3,622,261 | 11/1971 | Cotton | 8/116.4 |
| 3,960,482 | 6/1976 | Payet | 8/116.4 |

OTHER PUBLICATIONS

Reid et al., American Dyestuff Reporter, vol. 51, No. 5 pp. 19–23, 26 3/5/62.

Lewin et al., Textile Research Jour., vol. 37, No. 9 9/67.

Reid et al., American Dyestuff Reporter, vol. 49, No. 14, pp. 29–34, 7/11/60.

Reinhardt et al. Text. Chem. & Colorist vol. 3, No. 12 12/71.

Reinhardt et al., Text. Chem. & Colorist vol. 4, No. 3, 3/72.

Andrews et al., Textile Chem. & Colorist vol. 12, No. 11 11/80.

Reeves et al., American Dyestuff Reporter, vol. 49, No. 8 pp. 27–32 9/5/60.

*Primary Examiner*—Maria Parrish Tungol

*Attorney, Agent, or Firm*—Bell, Seltzer, Park & Gibson

[57] ABSTRACT

The level of released formaldehyde in a durable press treated fabric is significantly reduced or eliminated altogether by an oxidative aftertreatment process in which the fabric, after treatment with a formaldehyde-based durable press finishing agent and curing to impart durable press properties, is contacted with an oxidizing agent to destroy formaldehyde-releasing moieties present in the fabric. Preferably, the treatment of the durable press fabric with the oxidizing agent is carried out by impregnating the fabric with a solution containing the oxidizing agent and then providing the fabric a residence time in contact with the oxidizing agent to allow for reaction of the oxidizing agent with the formaldehyde-releasing moieties.

10 Claims, 1 Drawing Figure

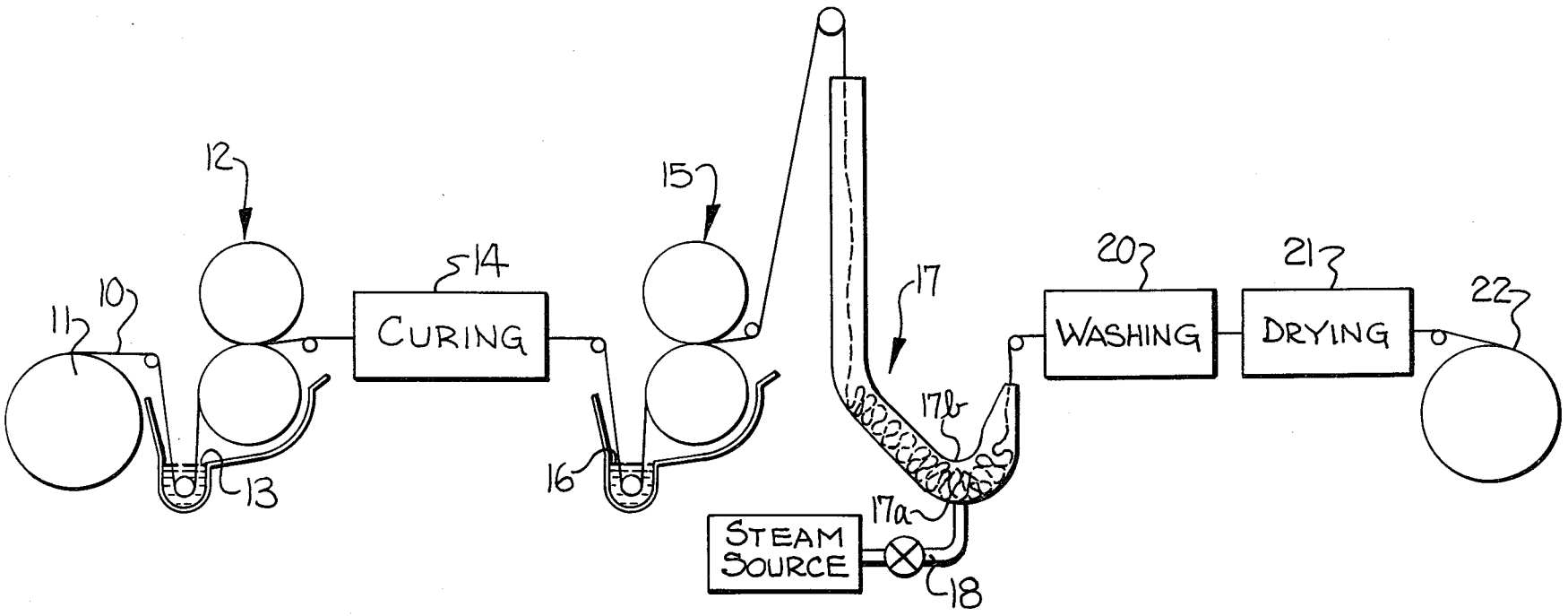
22
21
DRYING
20
WASHING
17
17b
17a
18
STEAM SOURCE
15
16
14
CURING
12
13
10
11

OXIDATIVE AFTERWASH TREATMENT FOR CREASE RESISTING FABRICS

Field and Background of the Invention

This invention relates to a finishing process for textile fabrics and more particularly to a durable press treatment process for textile fabrics containing cellulosic fibers.

In conventional finishing processes for imparting durable press properties to cellulose fiber-containing fabrics, the fabric is treated with a finishing agent, followed by heating to elevated temperature to ffect curing or crosslinking of the finishing agent and thereby impart crease resisting properties to the fabric. Many of the durable press treatment processes used commercially employ as the finishing agent a reactive resin based on formaldehyde. Perhaps the most commonly used reactive resin durable press finishing agent is dimethyloldihydroxyethyleneurea (DMDHEU), a formaldehyde-based resin formed from formaldehyde, glyoxal and urea. DMDHEU is commonly referred to in the industry as "glyoxal resin." There has also been a great deal of interest shown in durable press treatment processes which utilize formaldehyde itself as a reactive crosslinking agent for obtaining durable press properties. Generally, in these durable press treatment processes, the fabric is treated either with formaldehyde in the vapor phase or with an aqueous solution of formaldehyde. For example, commonly owned U.S. application Ser. No. 299,477, filed Sept. 4, 1981, and entitled Aqueous Formaldehyde Textile Finishing Process describes a process in which durable press properties are obtained by treating the fabric with aqueous formaldehyde.

Textile fabrics which have been treated with a formaldehyde-based finishing agent, such as those noted above, necessarily contain residual finishing agent from which formaldehyde can be released under conditions of storage and use. Released formaldehyde values in such fabrics typically range from 500 to 2000 ppm. Recent concern over the safety of human exposure to formaldehyde has prompted increasing interest in reducing the levels of released formaldehyde from durable press treated fabrics, and various approaches to the reduction of formaldehyde release have been proposed, including the use of formaldehyde scavengers such as amides, urea and ethyleneurea; pad bath additives such as polyols; and the use of various inorganic additives or aftertreatments, such as sodium bisulfite or sodium borohydride. See for example Andrews et al Textile Chemist and Colorist, Vol. 12, No. 11 (November 1980) pp. 287–291.

While these prior approaches have been successful to varying degrees in lowering the level of released formaldehyde, other accompanying problems, including reduction in crease-resistance, discoloration, chlorine retention, lack of durability, etc. have made these approaches less than fully satisfactory.

SUMMARY OF THE INVENTION

The present invention is based on the discovery that for fabrics that have been treated with a formaldehyde-based durable press finishing agent to achieve durable press properties, the level of released formaldehyde can be significantly reduced or eliminated altogether by subjecting the durable press finished fabric to an oxidative afterwash treatment in which a solution of an oxidizing agent is applied to the fabric and allowed to react with the formaldehyde-releasing moieties present in the fabric after durable press treatment. After this treatment the fabric may be optionally washed and thereafter dried. The oxidative afterwash treatment effectively destroys potential sources for released formaldehyde present in the fabric without adversely affecting the durable press performance or other fabric properties. The fabric shows a very significant reduction in the level of released formaldehyde after the oxidative afterwash treatment and, quite significantly, retains this reduced level of released formaldehyde over a long period of time.

The oxidative afterwash treatment of the present invention is especially suited for durable press fabrics which have been treated with formaldehyde as the finishing agent. Released formaldehyde values for such fabrics have been reduced from in excess of 1000 ppm to well below 100 ppm by this treatment. The present invention has also been shown to provide significant reduction in released formaldehyde for fabrics treated with formaldehyde-based resin finishing agents, such as glyoxal resin.

We have also determined that reduction in released formaldehyde to even further levels-essentially zero-is possible by a combination of the oxidative aftertreatment together with the addition of polyhydric alcohols as additives to the finishing agent bath. Suitable polyhydric alcohol finishing bath additives include ethylene glycol, diethylene glycol, glycerol, pentaerythritol, and low molecular weight carbohydrates.

It has been observed that fabrics which have been treated with a formaldehyde-based finishing agent tend initially to lose some of the releasable formaldehyde fairly easily, e.g. by washing. However while the released formaldehyde level is reduced initially, the washing is not fully effective in removing the releasable formaldehyde, and the fabric continues to release formaldehyde over a period of time.

In achieving effective long-term reduction of released formaldehyde, the present invention recognizes that the formaldehyde-based finishing agent present in the fabric following the durable press treatment process contains releasable formaldehyde in two forms: free and bound. The free releasable formaldehyde is not chemically bound to the fabric, and simple aftertreatments such as washing are fairly effective in removing it from the fabric. The term "bound" releasable formaldehyde refers to the formaldehyde releasing moieties present in formaldehyde-based finishing agent which is chemically bound to the cellulose, although the formaldehyde-releasing moiety may or may not be bound. Where the formaldehyde-releasing moiety is not itself chemically bound, such as by being tied up in a crosslink, it can split off from the finishing agent and be released as free formaldehyde at some later point in time. By contacting the durable press treated fabric with an oxidizing agent, these potential sources for long-term formaldehyde release are destroyed. This is accomplished without significantly affecting the level of crosslinking, which provides crease resistance to the fabric. This same treatment effectively removes residual free finishing agent from the treated fabric.

Preferably, the treatment of the durable press fabric with the oxidizing agent is carried out by impregnating the fabric with a solution containing the oxidizing agent and then providing the fabric a residence time in contact with the oxidizing agent to allow for reaction of the oxidizing agent with the residual finishing agent. This may be conveniently accomplished, for example, in a continuous operation by padding the fabric with a solution of the oxidizing agent, and then directing the fabric into a scray or J-box to provide a holding time prior to further processing. The fabric is preferably heated during the holding period to promote reaction of the oxidizing agent with the residual finishing agent. A particularly suitable and effective method for heating of the fabric is by steaming, which may be suitably accomplished by directing live steam into an enclosed scray or J-box. After treatment with the oxidizing agent, the fabric may be further processed, e.g. by drying or by washing and drying.

Any oxidant which will oxidize the formaldehyde-releasing moieties of the formaldehyde-based finishing agent can be employed as the oxidizing agent. Concentration levels can be suitably controlled so as to avoid overtreatment and loss of durable press and other fabric properties. A preferred class of oxidizing agents for use in the present invention are those selected from the group consisting of sodium perborate, hydrogen peroxide, and sodium hypochlorite. The oxidant is most conveniently applied as an aqueous solution, the concentration of oxidant preferably being up to about 5%, and most desirably on the order of about ½ to 3 percent. Auxiliaries such as oxidant stabilizer, buffer salts, swelling agents, fabric softeners and the like may be added to the oxidative treatment solution.

The oxidative afterwash treatment process of the present invention is especially useful and valuable with fabrics treated with formalin or formaldehyde as the finishing agent. However, the invention is also very useful with fabrics treated with formaldehyde-based resin-type finishing agents, such as glyoxal resin for example. In addition to glyoxal resin and formalin, other well known formaldehyde-based durable press finishing agents include ureaformaldehyde resin, dimethylolurea, dimethyl ether of ureaformaldehyde, melamine formaldehyde resins, cyclic ethylene urea formaldehyde resins, e.g. dimethylol ethylene urea, uron-formaldehyde resins, e.g. dimethylol uron, triazine-formaldehyde resins, and triazone-formaldehyde resins. This listing is not exhaustive (as there are many other known formaldehyde-based finishing agents) but is intended simply to illustrate the wide range of applicability of the treatment process of this invention.

The treatment process of this invention is applicable to any cellulose fiber-containing fabric. As the cellulosic fiber-containing fabric, there can be employed various natural or regenerated cellulose fibers and mixtures thereof, such as cotton, linen, ramie, and rayon, for example. These may be used alone or in blends with one or more other types of fiber such as polyesters, polyamides, acrylics, and polyolefins for example.

A further understanding of the present invention and its features and advantages will become apparent from the detailed description given hereinafter. It should be understood at the outset however, that the detailed description and specific example which follow are given by way of illustration only. They are intended to be understood as a broad, enabling teaching directed to persons skilled in the applicable art, and are not to be understood as restrictive, since various changes and modifications within the spirit and scope of the invention will become apparent to those skilled in the art.

BRIEF DESCRIPTION OF THE DRAWING

The drawing is a schematic diagram of an arrangement of apparatus suitable for practicing a continuous treatment process according to the invention .

DESCRIPTION OF ILLUSTRATED EMBODIMENT

As illustrated in the drawing, a woven textile fabric 10 containing a blend of cotton and polyester fibers is directed continuously from a supply roll 11 through a conventional pad apparatus generally indicated by the reference character 12, where it is immersed in and thoroughly impregnated with a formaldehyde-based durable press finishing agent 13. In the specific embodiment illustrated the finishing agent 13 is a conventional glyoxal resin-type finishing agent system, and includes an aqueous solution of glyoxal resin, together with a suitable curing catalyst, as is well known in the art. The pad bath may also contain conventional finishing bath auxiliary agents such as surfactants, softeners, penetrants, leveling agents, antifoam agents and the like which are well known to the finishing trade.

From the pad bath 12 the fabric 10 is directed into and through a curing oven 14 where it is heated to dry and cure the fabric, thereby imparting crease resisting properties to the fabric. Processing conditions for effecting drying and curing are well known in the art and need not be described in detail here.

Upon leaving the curing oven 14, the durable press treated fabric is directed into and through a second pad bath, generally indicated at 15, where the fabric is thoroughly impregnated with an impregnation solution 16. The impregnation solution 16 is an aqueous solution containing an oxidant, preferably one selected from the group consisting of sodium perborate, hydrogen peroxide and sodium hypochlorite.

Upon leaving the pad apparatus 15, the fabric is directed continuously into a holding zone formed by a scray apparatus or J-box 17. In the scray the fabric is deposited in loose folds to provide a residence time preferably of at least about a minute, and desirably longer. Increased holding time provides further reduction of released formaldehyde values, and the upper limit on holding time is essentially one of practicality. The oxidizing agent thus has an opportunity to thoroughly react with the formaldehyde-releasing moieties present in the fabric.

Preferably, the holding of the fabric in the scray 17 is accompanied by heating of the fabric so as to promote the reaction of the oxidizing agent with the finishing agent. In the specific embodiment illustrated, the heating is accomplished by steaming. In this regard, it will be noted that the scray 17 includes both a lower wall **17*a* and an upper wall 17*b* cooperating to form an enclosed chamber. A steam line 18** communicates with the enclosed scray for directing live steam into the enclosed chamber.

Upon leaving the scray 17, the fabric may be further processed as desired. In the embodiment illustrated, the fabric is directed through a conventional continuous washing range 20, and then into and through a continuous dryer apparatus 21, after which the fabric is formed into a roll 22 for convenience in storage and shipment.

It is to be understood that while the use of a heated scray 17 is illustrated as being preferred, it is not essential. In many instances, adequate destruction of the formaldehyde-releasing moieties can be accomplished simply by impregnation without the necessity of an additional holding period or further heating. It should also be understood that the washing of the fabric following the oxidative treatment is optional, and if desired the fabric could be directly subjected to further finishing operations without washing, or could be dried.

It should also be understood that while the drawings have illustrated an in-line continuous process, the invention is not limited thereto. For example, the oxidative afterwash treatment of the invention is equally applicable to batch processing where the fabric is accumulated in batches following the durable press curing step, and thereafter subjected to the oxidative afterwash. The afterwash treatment may be carried out, for example, by placing the durable press treated fabric in a batch dyeing machine or beck, for example, into which the oxidant solution is introduced. After heating or steaming for a suitable period of time in contact with the oxidant solution, the fabric may be washed and further processed in a conventional manner.

A further understanding of this invention can be obtained by reference to the following specific example, which is provided herein for purposes of illustration only and is not intended to be limiting.

EXAMPLE

Samples of a 65 percent polyester/35 percent cotton blend woven fabric were treated with an aqueous formaldehyde finish at a wet pick up of 70 percent, dried at 250 degrees F for 30 seconds and cured at 400 degrees F for 20 seconds. Finish bath formulation is shown in Table 1.

TABLE 1

| Aqueous Formaldehyde Finish | |
|---|---|
| Formalin | 66 g/l |
| Wetting agent | 1 g/l |
| Softener | 20 g/l |
| Catalyst | 16.5 g/l |

Samples were then after-treated with one each of the following:

water 2 percent hydrogen peroxide, 1 percent soda ash 1 percent sodium hypochlorite 2 percent sodium hypochlorite 1 percent sodium perborate 2 percent sodium perborate Treatment of the samples with the oxidizing agents used the following procedures:

1. Impregnated with chemical solution on padder, held at room temperature for 15 minutes by hanging vertically, then dried at 250 degrees F for one minute.
2. As Procedure #1, followed by rinsing in warm running water for one minute, extracted on padder and then dried at 250 degrees F for one minute.
3. Impregnated with chemical solution on padder, held at 180 degrees F in oven for 15 minutes and then dried.
4. As Procedure #3, except followed by rinsing in warm running water for one minute, extracted on padder and then dried at 250 degrees F for one minute.
5. Impregnated with chemical solution on padder, dried at 250 degrees F for 30 seconds and cured at 400 degrees F for 20 seconds.
6. Treated in beaker with chemical solution at the boil for 15 minutes, then extracted on padder and dried at 250 degrees F for one minute.
7. Treated in beaker at th boil for 15 minutes, rinsed in running warm water for one minute, extracted on padder and then dried a 250 degrees F for one minute.
8. Treated in beaker at 160 degrees F for 15 minutes, extracted on padder and dried at 250 degrees F for one minute.
9. Treated in beaker at 160 degrees F for 15 minutes, rinsed in running warm water for one minute, extracted on padder and then dried at 250 degrees F for one minute.

Immediately after drying, samples were sealed in bags for subsequent analysis of formaldehyde release by AATCC Test Method 112–1975 (Nash Reagent Option). The formaldehyde release test results are set forth in Table 2.

TABLE 2

RELEASED FORMALDEHYDE VALUES
AATCC Test Method 112-1975
Nash Reagent
Parts Per Million

| Treatment Method | Water | $H_2O_2$ $Na_2CO_3$ | 1% NaOCl | 2% NaOCl | 1% Perborate | 2% Perborate |
|---|---|---|---|---|---|---|
| 1. Open Scray 15 Minutes | 1018 | 177 | 1131 | 565 | 190 | 117 |
| 2. Same + Rinsed | 874 | 322 | 824 | 768 | 380 | 286 |
| 3. 180° Scray 15 Minutes | 1565 | 678 | 1230 | 1341 | 1451 | 104 |
| 4. Same + Rinsed | 1099 | 574 | 902 | 810 | 454 | 552 |
| 5. Pad-Dry-Cure | 909 | 283 | 666 | 661 | 217 | 24 |
| 6. Beaker at 212° F./15 Min. | 109 | 0 | 154 | 94 | 64 | 0 |
| 7. Same + Rinsed | 92 | 0 | 116 | 60 | 62 | 0 |
| 8. Beaker at 160° F./15 Min. | 161 | 72 | 210 | 227 | 63 | 0 |
| 9. Same + Rinsed | 197 | 73 | 174 | 166 | 92 | 0 |

Control (No Aftertreatment) = 1113 ppm

From the above tests, the following observations were made:

1. For the formalin finished samples, after-treatments of hydrogen peroxide or 2 percent sodium perborate gave the best results.
2. Of the procedures tested, boiling for 15 minutes was the most effective, followed by heating at 160 degrees F for 15 minutes.
3. Zero levels of liberated formaldehyde are attainable by oxidative aftertreatments.

In the drawing and specification, there have been set forth preferred embodiments of the invention, and although specific terms are employed, they are used in a generic and descriptive sense only and not for purposes of limitation.

That which is claimed is:

1. A durable press treatment process for textile fabrics containing cellulosic fibers, said process being characterized by producing a durable press fabric having significantly reduced levels of released formaldehyde, and said process comprising applying to the fabric a formalin durable press finishing agent, directing the fabric through a curing oven and heating the fabric to effect crosslinking and impart durable press properties to the fabric while leaving in the fabric formaldehyde which can be liberated under conditions of storage and use, and impregnating the cured durable press treated fabric with an aqueous solution containing an oxidizing agent selected from the group consisting of sodium perborate, hydrogen peroxide, and sodium hypochlorite and maintaining the fabric in contact with the oxidizing agent for a time and at a temperature sufficient to oxidize and destroy releasable formaldehyde present in the fabric without destroying the durable press properties imparted to the fabric.

2. A durable press treatment process for textile fabrics containing cellulosic fibers, said process being characterized by producing a durable press fabric having significantly reduced levels of released formaldehyde, and said process comprising impregnating the fabric with a finishing bath containing a formalin finishing agent and a polyhydric alcohol finishing bath additive, directing the thus impregnaed fabric through a curing oven and heating the fabric to effect crosslinking of the finishing agent and impart durable press properties to the fabric, and impregnating the thus treated durable press fabric with an aqueous solution containing an oxidizing agent selected from the group consisting of sodium perborate, hydrogen peroxide, and sodium hypochlorite, and maintaining the fabric in contact with the oxidizing agent for a time and at a temperature sufficient to oxidize and destroy releasable formaldehyde present in the fabric without destroying the durable press properties imparted to the fabric.

3. A process as set forth in claim 1 or 2 wherein the step of maintaining the fabric in contact with the oxidizing agent is accompanied by heating of the fabric.

4. A process as set forth in claim 3 wherein the heating of the fabric comprises steaming.

5. A process as set forth in claim 1 or 2 wherein the step of maintaining the fabric in contact with the oxidizing agent comprises directing the impregnating fabric into a scray.

6. A continuous durable press treatment process for textile fabrics containing cellulosic fibers, said process being characterized by producing a durable press fabric having significantly reduced levels of released formaldehyde, and said process comprising the steps of continuously advancing the fabric along a predetermined path of travel and applying to the fabric a formalin durable press finishing agent, directing the fabric containing said finishing agent into a through and curing oven and heating the fabric to effect crosslinking and impart durable press properties to the fabric while leaving in the fabric formaldehyde which can be released under conditions of storage and use, continuously directing the fabric from the curing oven to an impregnating station and impregnating the fabric with an oxidizing agent for the formalin durable press finishing agent, continuously directing the thus impregnated fabric from the impregnating station into a holding zone and allowing the impregnated fabric a residence time in said holding zone sufficient to permit the oxidizing agent to react with releasable formaldehyde present in the fabric but without destroying the durable press properties imparted to the fabric, and directing the fabric from the holding zone.

7. A process as set forth in claim 6 including the step of heating the impregnated fabric while in said holding zone.

8. A process as set forth in claim 6 including the further steps of continuously receiving the fabric from said holding zone and directing the fabric successively through a washer and a dryer.

9. A process as set forth in claims 7 or 8 wherein the bath containing said finishing agent also contains a polyhydric alcohol.

10. A textile fabric treated by the process as set forth in any one of claims 1, 2 or 6.

* * * * *

UNITED STATES PATENT AND TRADEMARK OFFICE

CERTIFICATE OF CORRECTION

PATENT NO. : 4,447,241

DATED : May 8, 1984

INVENTOR(S) : James E. Hendrix & George Louis Payet

It is certified that error appears in the above-identified patent and that said Letters Patent are hereby corrected as shown below:

On the title page Item (56)
In the 1st listed publication "Reid et al. ... "pages 19-23" should be -- pp. 19-22. --.

Column 1, line 13, "ffect" should be -- effect --.

Column 5, line 49, after the word perborate "Treatment" should start a new paragraph.

Column 6, line 6, after the word at "th" should be -- the --.

Column 6, line 7, after the word dried "a" should be -- at --.

Column 6, line 50, after the word peroxide "or" should be -- and --.

Column 7, line 21, "impregnaed" should be -- impregnated --.

Signed and Sealed this

*Twelfth* Day of *March 1985*

[SEAL]

*Attest:*

DONALD J. QUIGG

*Attesting Officer* *Acting Commissioner of Patents and Trademarks*